US011844450B1

(12) United States Patent
Peter

(10) Patent No.: US 11,844,450 B1
(45) Date of Patent: Dec. 19, 2023

(54) PARTIALLY DIVIDED BED SHEETS FOR HUMAN BEDDING

(71) Applicant: Deborah L Peter, Kutztown, PA (US)

(72) Inventor: Deborah L Peter, Kutztown, PA (US)

( * ) Notice: Subject to any disclaimer, the term of this patent is extended or adjusted under 35 U.S.C. 154(b) by 0 days.

(21) Appl. No.: 18/091,688

(22) Filed: Dec. 30, 2022

(51) Int. Cl.
*A47G 9/02* (2006.01)

(52) U.S. Cl.
CPC ..... *A47G 9/023* (2013.01); *A47G 9/02* (2013.01); *A47G 9/0207* (2013.01)

(58) Field of Classification Search
CPC ..... A47G 9/023; A47G 9/0207; A47G 9/02
USPC ..... 5/486, 482
See application file for complete search history.

(56) References Cited

U.S. PATENT DOCUMENTS 4,573,227 A * 3/1986 Prandina ..... A47G 9/0207 5/486
5,023,969 A * 6/1991 Nattrass ..... A47G 9/023 5/486
5,287,573 A 2/1994 Ritacco
6,311,347 B1 * 11/2001 Limardi ..... A47G 9/0223 5/482
6,643,871 B1 * 11/2003 Robke ..... A47G 9/0223 5/482
7,200,883 B2 4/2007 Haggerty
8,973,183 B1 3/2015 Palashewski et al.
9,179,790 B2 11/2015 Messina
2006/0130234 A1 * 6/2006 Poulin ..... A47G 9/0238 5/486
2007/0061967 A1 3/2007 Fox
2014/0352062 A1 * 12/2014 Messina ..... A47G 9/023 5/495
2015/0342376 A1 * 12/2015 Hallan ..... A47G 9/023 5/486

* cited by examiner

*Primary Examiner* — Robert G Santos
(74) *Attorney, Agent, or Firm* — Sanford J. Piltch

(57) ABSTRACT

A partially divided flat top sheet includes first and second flat top sheet panels, with the first flat sheet panel partially overlying the second flat sheet panel. Both flat sheet panels are secured together at a bottom portion thereof at a predetermined overlap distance with the securing being by permanently sewing the flat top sheet panels to each other along the edges of the overlap portion and at a predetermined distance from the bottom of the partially divided flat top sheet. The partially divided flat top sheet also includes reinforcement sew points for maintaining the flat top sheet panels in alignment with an overlying covering.

5 Claims, 4 Drawing Sheets

PARTIALLY DIVIDED BED SHEETS FOR HUMAN BEDDING

BACKGROUND OF THE INVENTION

The present invention can be generally described as specialized bed linens for human use on double, queen, or king-sized beds. The specialized bed sheet apparatus has a central overlapping section extending from each side onto the other side, with the overlaps extending a predetermined distance from one side onto the other side. The specialized bed sheet is split along the central overlap section a distance along the length of the bed sheet from top to bottom in order that co-sleepers can each control the extended upper portions of the bed sheet for their individual use.

Over the years a number of devices have been conceived and used that provide for similar functioning. Most, if not all, are structured to provide for a split sheet system for use with top split independently controlled mattress systems. Some of the devices describe a split sheet system, split between right and left sides, as well as a minimal overlap along the center of the sheet.

One such split sheet device is shown in U.S. Pat. No. 9,179,790 [Messina] that describes a sheet system having a central overlay with an overlap connection solely at the bottom of the sheet system linking the adjoining panels along the front of the underlying mattress with the sheet to be tucked under the mattress. Each of the two portions are described as two separate panels with an overlapping center section for use independent of the other by individual sleepers. It is to be noted that the overlay section is separated from the joined bottom portions of the two panels such that limited motion can be had in the upward and outward directions. This sheet system differs from the present invention in that this sheet system provides for attachment only at the bottom giving rise to the potential for disengagement of the two sections from each other that is not possible in the present invention.

Another device is shown in U.S. Pat. No. 8,973,183 [Palashewski, et al.] that describes a specialized sheet system for use with a split sided mattress system having upper and lower mattress adjustment sections. Each panel of the sheet system is fitted to the like adjustable mattress section with a central joined portion permanently attaching to two side sections together. See, FIGS. 8, 14. Alternatively, only the upper section of the split side sheet system is free to move independently of the other side with a bottom joined section permanently attaching the two sides together. It is also to be noted that the described sheet systems are for fitted bottom sheets only and that there is no overlay section indicated as being part of the specialty sheet system unlike the present invention where there is not only an overlay region, but also an extended bottom joined section to prevent the separation of the independent sections of the sheet system.

A split bed cover and sheet device is shown in U.S. Patent Application Publication No. US2007/0061967A1 [Fox] describing a bed cover system, including at least one of a sheet, blanket, spread or comforter, that is split along the entire length of the bed. The bed cover system is joined only at the bottom in the region that is folded over and/or tucked under the mattress. This specialty cover system does not exhibit, describe or suggest any overlay of one side section onto the other unlike the present invention that requires such overlay for the completeness of covering the individual sleepers as the present invention is being utilized.

It is therefore an object of the present invention to provide a bed sheet system that is sized for the mattress size and is permanently joined at a central bottom position of the bed sheet system allowing for independent upper section motion of each sheet panel, especially in the overlay central section of the sheet system. It is also an object of the present invention to alternatively provide a bed sheet system that is sized for the mattress size and is permanently joined along a sew line across the sheet system from the outer edge of each panel, also allowing for independent upper section motion of each sheet panel, especially in the overlay central section of the sheet system. Still a further object of the present invention is to provide a series of snaps or other attachment means to secure the sheet system to an overlying blanket or blankets, or other bed covering, such that the sheet system and the blanket(s) or coverings remain substantially aligned with the other. Further, another object of the present invention is to permit the specialty sheet system to be used on articulating beds or mattresses in the same fashion as fixed surface beds or mattresses.

Other objects will appear hereinafter.

SUMMARY OF THE INVENTION

A partially divided flat top sheet comprising a first and second flat top sheet panels, with the first flat top sheet panel partially overlying the second flat top sheet panel in the width direction. Both of the flat top sheet panels are secured together at a bottom portion thereof at a predetermined overlap distance of at least 50 percent of the width of either the first or the second flat top sheet panel. The flat top sheet panels are secured together by permanently sewing the first and second flat top sheet panels to each other along the edges of the overlap portion and at a predetermined distance from the bottom of the partially divided flat top sheet of at least 25 percent of the length of the first and second flat top sheet panels. This permits the upper portions of the first and second flat top sheet panels to move with the individual sleeper without disturbing the other sleeper.

The bottom portion of the first and second flat top sheet panels is permanently secured by sew lines along the inner edges of the first and second flat top sheet panels to the other flat top sheet panel and along a sew line running between said sewn edges at the predetermined distance from the bottom edges of the first and second top flat sheet panels forming a rectangle spanning the width between the inner edges of the first and second top flat sheet panels. Alternatively, the bottom portion of the first and second flat top sheet panels are permanently secured by sew lines along the edges of the first and second flat top sheet panels to the other flat top sheet panel and along a sew line running between the outer edges of the first and second top flat sheet panels at the predetermined distance from the bottom edges of the first and second top flat sheet panels forming a rectangle spanning the entire width of the partially divided top flat sheet.

The partially divided flat top sheet may also include reinforcement portions located at the junction of the sew lines along the edges of the first and second flat top sheet panels to the other top flat sheet panel and along the sew line at the predetermined distance from the bottom of the partially divided flat top sheet creating reinforcement points for maintaining the first and second flat top sheet panels from ripping and tearing away from each other. The partially divided flat top sheet may further include a plurality of securing points for securing the first and second flat top sheet panels to an overlying covering for maintaining the covering in alignment with the corresponding underlying first and second flat top sheet panel.

BRIEF DESCRIPTION OF THE DRAWINGS

For the purpose of illustrating the invention, there are shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense and is made solely for the purpose of illustrating the general principles of the invention. The various features and advantages of the present invention may be more readily understood with reference to the following detailed description taken in conjunction with the accompanying drawings.

Figure 1:
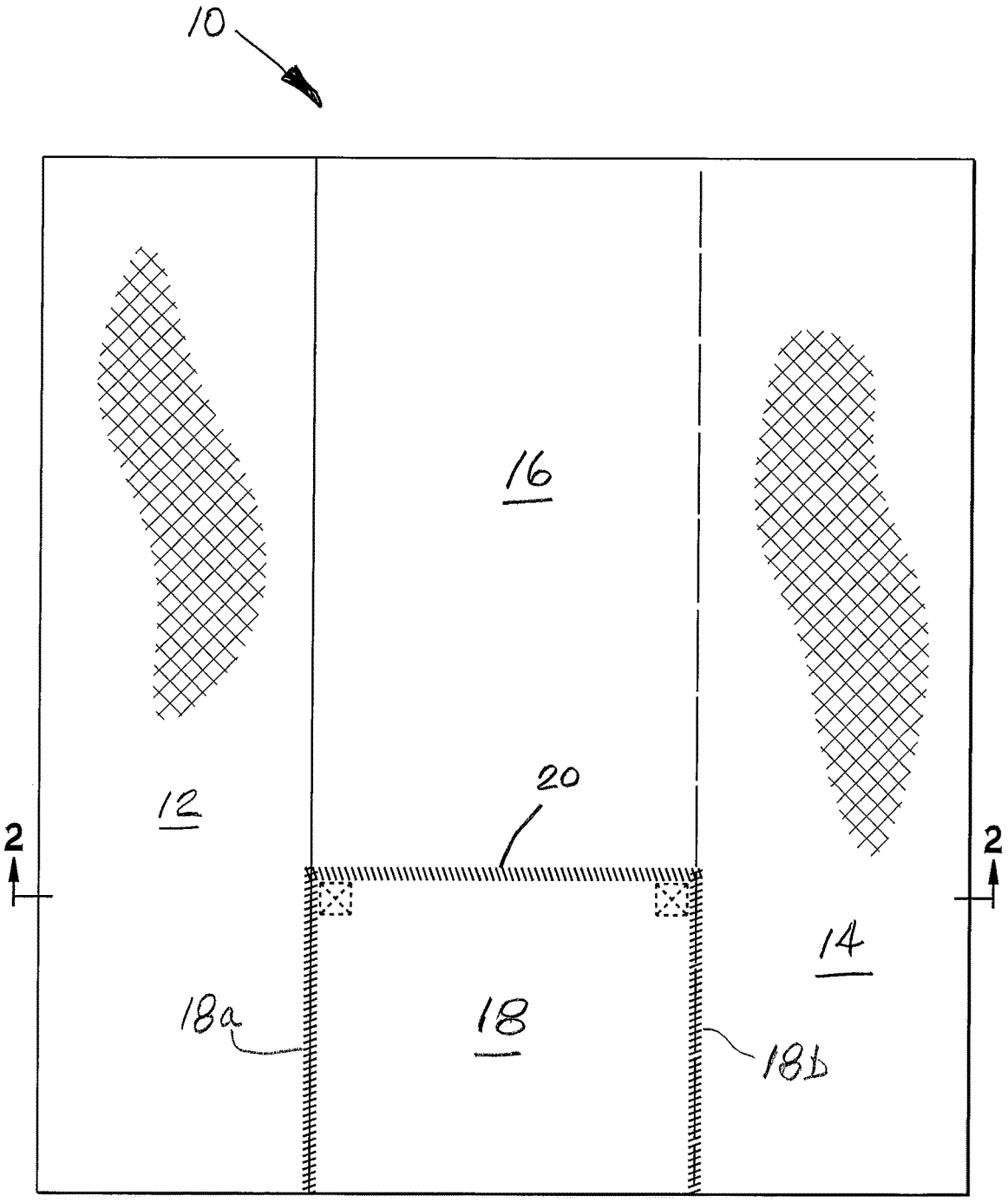
FIG. 1 is a plan view of a first embodiment of the specialty sheet apparatus of the present invention showing both sheet panels with their overlying central portion with a box-like sewing line for permanent joining of the panels along the extent of the overlay and along a predetermined section of a bottom portion of the specialty sheet apparatus.
Figure 2:
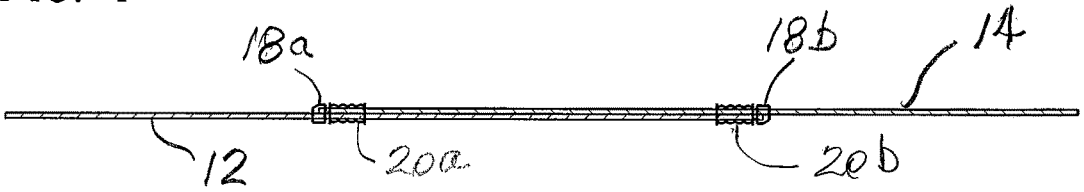
FIG. 2 is a side view of the first embodiment of the specialty sheet apparatus of the present invention taken along Line 2-2 of FIG. 1 showing the extent of the panel overlay.

It is to be understood that the overall bed sheet sizing of the present invention will correspond to the standard bed sheet sizing for full, queen, king and California king mattress systems. A full flat sheet is approximately sized with a length of 102 inches and a width of 96 inches. A queen flat sheet is sized at a minimum dimension similar to the full flat sheet but may also be sized at larger dimensions approaching those of a king flat sheet. Both king and California king flat sheets are sized approximately for a length of 112 inches in length and 102 inches in width but may be larger in each of the listed dimensions. Flat sheets are intended to lie flat atop the mattress (and any fitted bottom sheet) and should be dimensioned such that extra fabric can hang over the sides and bottom of the mattress and be tucked under the mattress to retain the flat sheet in its intended position. These listed dimensional sizes of approximate lengths and widths of the flat sheets are incorporated as the approximate dimensions of each flat sheet overall dimensions for each bed system described below Referring now to the drawings in detail, where like numerals refer to like parts or elements, there is shown in FIG. 1 a plan view of a first embodiment of the specialty sheet apparatus 10 of the present invention showing both sheet panels 12, 14 with their overlying central portion 16 with a box-like bottom section 18 for permanently joining the panels 12, 14 along the extent of the overlay and along a predetermined section 20 of the joined bottom portion 20 of the specialty sheet apparatus 10 of the present invention. FIG. 2 shows each panel 12, 14 with panel 14 overlying panel 12 with sewing attachment lines 18*a*, 18*b* for permanently attaching the two panels 12, 14 together. Also shown in FIG. 2 are the cross-sheet sew line 20 for creating a permanent sew line for maintaining the two panels 12, 14 connected to each other at the predetermined bottom portion 18 of the sheet system, as well as reinforcement portions 20*a*, 20*b* providing reinforcement against the tearing apart of the two sheet panels 12, 14 from each other during use. Thus, the sheet system of the present invention has two panels 12, 14 that overlie one another approximately one-half to 60% of the width of each panel and are joined together to maintain this dimensional overlay at a central bottom portion 18 defined by the sew lines 18*a*, 18*b* and the cross-section sew line 20. The cross-sheet sew line 20 is positioned approximately at a length dimension of between 20% and 25% of the overall length of the sheet apparatus. The overall length and width dimensions of the sheet panels are as described above for each of the flat sheet sizes for the various mattress systems.

Figure 3:
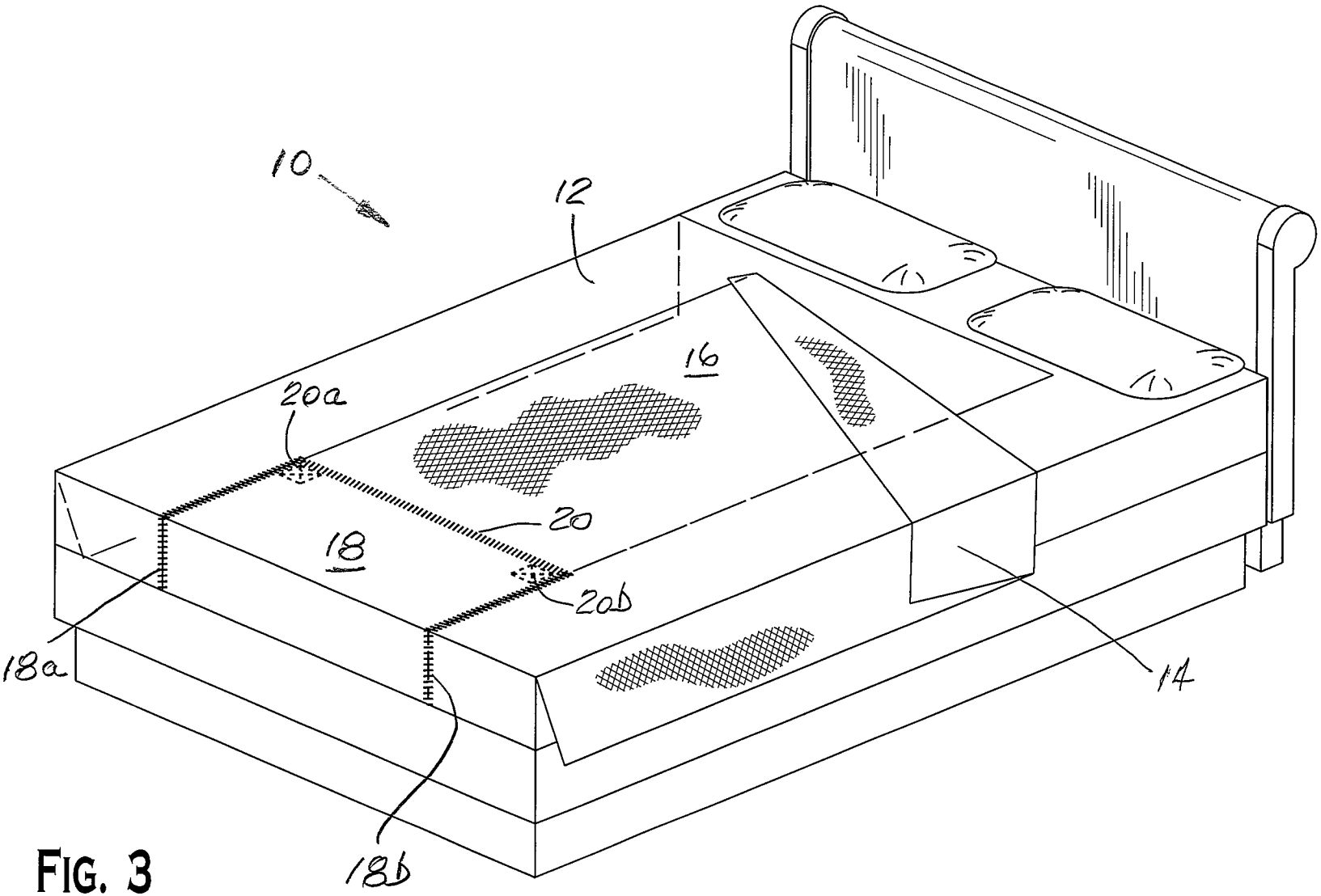
FIG. 3 is a perspective view of the first embodiment of the specialty sheet apparatus of the present invention with the specialty sheet apparatus positioned atop a bed.

Referring now to FIG. 3, the present invention is shown as a perspective view of the first embodiment of the specialty sheet apparatus 10 of the present invention with the specialty sheet apparatus 10 positioned atop a bed with sheet panel 14 partially folded down exposing sheet panel 12 beneath and overlying portion of sheet panel 14. One can readily discern that the specialty sheet apparatus 10 extends beyond the width dimension of the mattress with each of the side panels 12, 14 hanging down the side of the mattress a sufficient distance to be tucked under the mattress. Also, the bottom section of the specialty sheet apparatus 10 hangs down over the bottom side of the mattress a sufficient distance to be tucked under the mattress. Each of the sheet panels 12, 14 that extend above the bottom section 18 are free to move apart from their respective overlaying rest positions to accommodate individual sleep patterns without disturbing the other individual in the bed while using the partially divided bed sheet apparatus 10 of the present invention.

Figure 4:
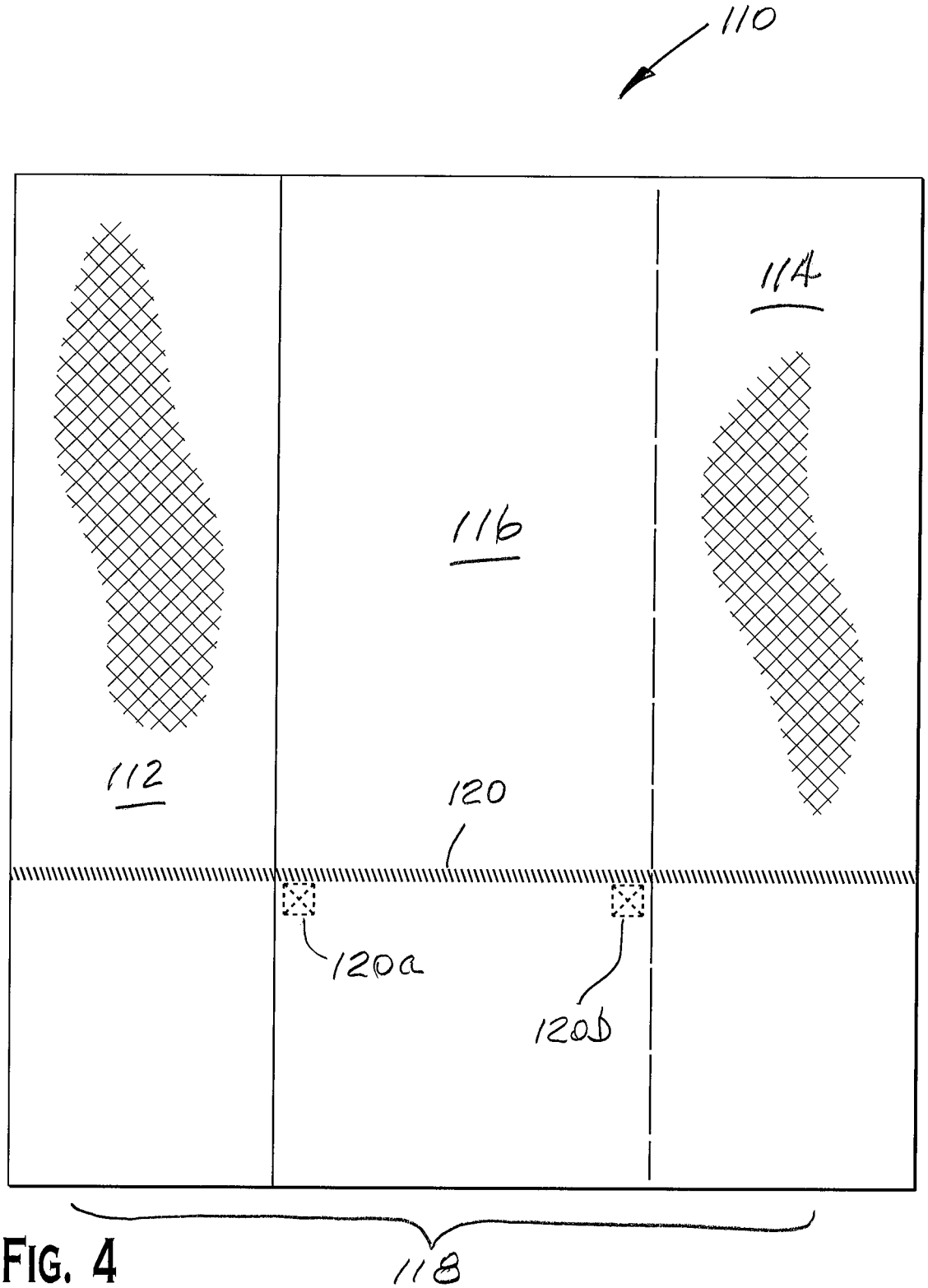
FIG. 4 is a plan view of a second embodiment of the specialty sheet apparatus of the present invention showing both sheet panels with their overlying central portion with a straight sewing line for permanent joining of the panels along a predetermined section of a bottom portion of the specialty sheet apparatus.
Figure 5:
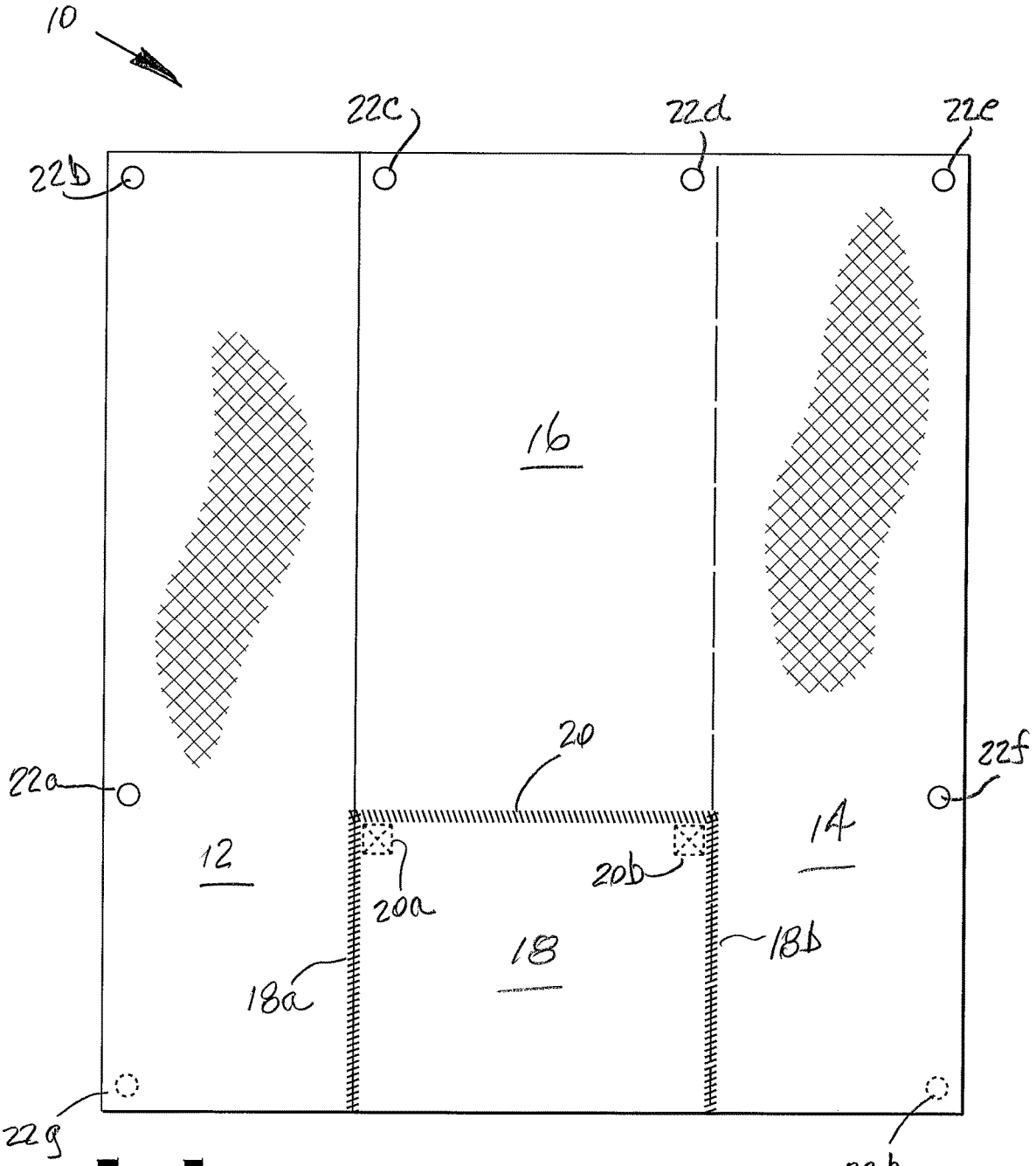
FIG. 5 is a plan view of the first embodiment of the specialty sheet apparatus of the present invention showing the locations of a plurality of fasteners for fastening the specialty sheet apparatus to an overlying blanket or cover.

A second embodiment of the specialty sheet apparatus 110 of the present invention is shown FIG. 4 where both sheet panels 112, 114, with their overlying central portion 116, have a bottom portion 118 created by a straight sewing line 120 for permanent joining of the panels 112, 114 along a predetermined section of a bottom portion of the specialty sheet apparatus 110. In this embodiment, the two side panels 112, 114 are sewn across the bottom edge of the partially divided sheet apparatus 110, as well as along cross-sheet sew line 120. The cross-sheet sew line 120 is, again, positioned approximately at a length dimension of between 20% and 25% of the overall length of the sheet apparatus 110. Thus, the specialty sheet apparatus 110 extends beyond the width dimension of the mattress with each of the side panels 112, 114 hanging down the side of the mattress a sufficient distance to be tucked under the mattress. Also, the bottom section of the specialty sheet apparatus 110 hangs down over the bottom side of the mattress a sufficient distance to be tucked under the mattress. As with the first embodiment, each of the sheet panels 112, 114 that extend above the bottom section 118 are free to move apart from their respective overlaying rest positions to accommodate individual sleep patterns without disturbing the other individual in the bed while using the partially divided bed sheet apparatus 110 of the present invention Although the present invention of the partially divided flat top sheet 10, 110 cures the prior problems of freedom of movement with the sheet and coverings following the individual sleeper, there remains another concern, i.e., the coverings following the movement of the divided flat top sheet 10, 110. With reference to FIG. 5 that is to be considered exemplary for both of the embodiments described above, there are shown a plurality of buttons 22*a-f* (and hidden buttons 22*g-h*) that are utilized to secure whatever covering one desires, e.g., blanket, duvet, etc., with the partially divided top sheet 10, 110. Each covering (not shown) is fixedly attached to the corresponding underlying sheet panel 12, 112 and 14, 114. In this manner, wherever the partially divided top sheet panel 12, 112 and 14, 114 moves, the covering moves with corresponding underlying panel.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A partially divided flat top sheet comprising first and second flat top sheet panels, with the first flat sheet panel partially overlying the second flat sheet panel in the width direction, both flat sheet panels being secured together at a bottom portion thereof at a predetermined overlap distance of at least 50 percent of the width of either the first or the second flat sheet panel, with the securing being by permanently sewing the first and second flat sheet panels to each other along the inner edges of the overlap portion and at a predetermined distance from the bottom of the partially divided flat top sheet of at least 25 percent of the length of the first and second flat top sheet panels permitting upper portions of the first and second flat top sheet panels to move with an individual sleeper without disturbing the other sleeper.

2. The apparatus of claim 1 wherein said bottom portion of the first and second flat top sheet panels are permanently secured by sew lines along the edges of both the first and second flat top sheet panels to the other flat top sheet panel and along a sew line running between said sewn edges at the predetermined distance from the bottom edges of the first and second flat top sheet panels forming a rectangle spanning the width between the inner edges of the first and second flat top sheet panels.

3. The apparatus of claim 1 wherein said bottom portion of the first and second flat top sheet panels are permanently secured by sew lines along the edges of both the first and second flat top sheet panels to the other flat top sheet panel and along a sew line running between the outer edges of the first and second flat top sheet panels at the predetermined distance from the bottom edges of the first and second flat top sheet panels forming a rectangle spanning the entire width of the partially divided top flat sheet.

4. The apparatus of claim 1 further comprising reinforcement portions located at the junction of the sew lines along the edges of both the first and second flat top sheet panels to the other top flat sheet panel and along the sew line at the predetermined distance from the bottom of the partially divided flat top sheet creating reinforcement points for maintaining the first and second flat top sheet panels from ripping and tearing away from each other.

5. The apparatus of claim 1 further comprising a plurality of securing points for securing the first and second flat top sheet panels to an overlying covering for maintaining the covering in alignment with the corresponding underlying first and second flat top sheet panels so that the overlying covering moves with the corresponding underlying flat sheet panel.

* * * * *